US010051912B2

(12) United States Patent
Darden et al.

(10) Patent No.: US 10,051,912 B2
(45) Date of Patent: Aug. 21, 2018

(54) TUNING ELEMENTS FOR FOOTWEAR

(71) Applicant: Vans, Inc., Cypress, CA (US)

(72) Inventors: Edwin S. Darden, Cypress, CA (US); Tristan Modena, Venice, CA (US)

(73) Assignee: Vans, Inc., Costa Mesa, CA (US)

( * ) Notice: Subject to any disclaimer, the term of this patent is extended or adjusted under 35 U.S.C. 154(b) by 0 days.

(21) Appl. No.: 14/648,676

(22) PCT Filed: Nov. 27, 2013

(86) PCT No.: PCT/US2013/072319
§ 371 (c)(1),
(2) Date: May 29, 2015

(87) PCT Pub. No.: WO2014/085646
PCT Pub. Date: Jun. 5, 2014

(65) Prior Publication Data

US 2015/0313309 A1 Nov. 5, 2015

Related U.S. Application Data

(60) Provisional application No. 61/732,055, filed on Nov. 30, 2012.

(51) Int. Cl.
*A43B 3/00* (2006.01)
*A43B 5/04* (2006.01)
(Continued)

(52) U.S. Cl.
CPC ..... *A43B 5/0401* (2013.01); *A43B 3/0005* (2013.01); *A43B 3/0031* (2013.01);
(Continued)

(58) Field of Classification Search
CPC ... A43B 3/0005; A43B 3/0031; A43B 5/0401; A43B 5/0405; A43B 5/0454;
(Continued)

(56) References Cited

U.S. PATENT DOCUMENTS 5,101,582 A 4/1992 Pozzobon
5,113,526 A * 5/1992 Wang ..... A43B 7/32 2/10
(Continued)

FOREIGN PATENT DOCUMENTS

CN 662483 10/1987
EP 1356746 10/2003
(Continued)

OTHER PUBLICATIONS

Office Action dated Oct. 21, 2016, in Korean Patent Application No. 10-2015-7016914.
(Continued)

*Primary Examiner* — Sharon M Prange
(74) *Attorney, Agent, or Firm* — Ganz Pollard, LLC

(57) ABSTRACT

One or more tuning elements may be associated with a receiver, such as a pocket or other channel, disposed on an item of footwear, such as a snowboarding boot. The receiver adjustably receives the tuning element. The adjustable arrangement of the tuning element and receiver allows the intended user of the item of footwear to tune the item for performance, comfort, cosmetic, or other characteristics. In certain embodiments, the tuning elements are removably associated with a boot to allow for flex control.

14 Claims, 13 Drawing Sheets

(51) Int. Cl.
*A43B 23/26* (2006.01)
*A43B 23/02* (2006.01)

(52) U.S. Cl.
CPC ..... *A43B 5/0405* (2013.01); *A43B 5/0454* (2013.01); *A43B 5/0464* (2013.01); *A43B 23/0265* (2013.01); *A43B 23/26* (2013.01)

(58) Field of Classification Search
CPC ..... A43B 5/0458; A43B 5/0464; A43B 23/26; A43B 23/0265
USPC ..... 36/118.2, 118.3, 118.5, 118.6, 132, 54
See application file for complete search history.

(56) References Cited

U.S. PATENT DOCUMENTS

| | | | | |
|---|---|---|---|---|
| 5,265,353 | A * | 11/1993 | Marega | A43B 5/0405 36/117.6 |
| 5,329,706 | A | 7/1994 | Pozzobon | |
| 5,490,337 | A | 2/1996 | Zerbinati | |
| 5,606,808 | A * | 3/1997 | Gilliard | A43B 5/0401 36/100 |
| 5,647,146 | A | 7/1997 | Gabrielli et al. | |
| 6,360,454 | B1 * | 3/2002 | Dachgruber | A43B 5/0401 36/117.1 |
| 6,519,877 | B2 | 2/2003 | Oetting et al. | |
| 6,935,054 | B2 * | 8/2005 | Hall | A43B 3/0031 36/107 |
| 8,217,788 | B2 | 7/2012 | Vock et al. | |
| 8,381,419 | B2 * | 2/2013 | Fenato | A43B 5/0411 36/117.4 |
| 9,232,828 | B2 * | 1/2016 | Arlen | A43B 5/0401 |
| 2002/0055696 | A1 * | 5/2002 | Borsoi | A43B 5/0458 602/32 |
| 2003/0115777 | A1 | 6/2003 | Hall et al. | |
| 2004/0010942 | A1 * | 1/2004 | Caeran | A43B 5/0454 36/50.5 |
| 2005/0178028 | A1 | 8/2005 | Light | |
| 2007/0006489 | A1 * | 1/2007 | Case, Jr. | A43B 3/0005 36/132 |

FOREIGN PATENT DOCUMENTS

| | | |
|---|---|---|
| EP | 1634506 | 3/2006 |
| JP | 2618750 B2 | 6/1991 |
| JP | A H03-151902 | 6/1991 |
| JP | 2618750 | 6/1997 |
| JP | U 3087524 | 8/2002 |
| JP | 2009500141 A | 1/2009 |
| WO | 0333692 | 6/2000 |
| WO | 0149142 | 7/2001 |

OTHER PUBLICATIONS

Extended European Search Report dated Nov. 23, 2016, in European Patent Application No. 138579875.
International Search Report /Written Opinion in Application No. PCT/US13/72319 dated Apr. 18, 2014.
Canadian Office Action for Canadian Patent Application No. 2893334 dated Apr. 27, 2016.
Japanese Office Action for Japanese Patent Application No. 2015-545452 dated Jul. 4, 2016.
Office Action dated Oct. 27, 2016, in Chinese Patent Application No. 201380071611.9.
Office Action dated Mar. 21, 2017 for co-pending Japanese Application No. 2015-548019.
Search Report dated Mar. 23, 2017 for co-pending Russian Application No. 2015124788.

* cited by examiner

TUNING ELEMENTS FOR FOOTWEAR

RELATED APPLICATIONS

This application claims the benefit of and priority to U.S. Provisional Application Ser. No. 61/732,055, filed Nov. 30, 2012, the contents of which are hereby incorporated by reference as if recited in full herein for all purposes.

BACKGROUND

The inventive subject matter in its various possible embodiments is directed to one or more tuning elements that may be associated with a receiver, such as a pocket or other channel, disposed on an item of footwear, such as a snowboarding boot. The receiver adjustably receives the tuning element. In some embodiments, the tuning element is removably received in a pocket or other channel associated with a tongue for an item of footwear. The adjustable arrangement of the tuning element and receiver allows the intended user of the item of footwear to tune the item for performance, comfort, cosmetic or other characteristics. In certain embodiments, the tuning elements are removably associated with a boot to allow for flex control.

Typically, items of footwear provide a user with fixed set of features that do not allow a user to tune the footwear to desired needs. While there are some known systems that may provide for more adjustability, such as flex control, such systems have limits and disadvantages. For example, known snow sports footwear systems that might allow for variable flex adjustments in a boot do not allow for a full range of tuning options keyed to anatomy and performance needs. For example, they do not allow for selective tuning at lateral or medial sides of the boot. Or they do not allow for quick adjustments on the fly or while sitting on a chair lift, for example. Other known systems in the prior art may affect performance or comfort by, for example, creating pressure points or by compromising overall flex characteristics of a boot.

The known systems also do not allow for a multiple features or utilities to be integrated into a single system. For example, known systems that are directed to flex control do not have or at least do not adequately integrate features for other performance, comfort, or cosmetic needs into a single system.

The foregoing is not intended to be an exhaustive listing of disadvantages of the prior art and needed improvements; it is only a sampling. In view of the foregoing, there is a substantial need for improved systems for adjusting and tuning items of footwear to the needs of users.

SUMMARY

The inventive subject matter overcomes the disadvantages of the prior art and provides various improvements. The inventive subject matter includes the embodiments disclosed herein, as well as various permutations of features that are within the scope and spirit of the disclosure and teachings of this document.

The following is a description of various inventive lines under the inventive subject matter. The appended claims, as originally filed in this document, or as subsequently amended, are hereby incorporated into this Summary section as if written directly in.

In broad terms, according to the inventive subject matter, one or more tuning elements may be associated with a receiver, such as a pocket or other channel, disposed on an item of footwear, such as a snowboarding boot. The receiver adjustably receives the tuning element. The adjustable arrangement of the tuning element and receiver allows the intended user of the item of footwear to tune the item for performance, comfort, cosmetic or other characteristics. In certain embodiments, the tuning elements are removably associated with a boot to allow for flex control.

In certain embodiments, the inventive subject matter is directed to a flex-control system that includes a first tuning element for a boot, the tuning element comprising a semi-flexible element in a three-dimensional configuration that generally conforms to a lateral or medial side of an ankle joint region of an intended user's lower leg and foot and extends sufficiently above and below the ankle joint area so as to increase the boots resistance to flex in the ankle joint region. In the foregoing embodiment and other embodiments contemplated herein, the tuning element may include a flex zone that is a transition zone where the tuning element angles or curves from a first plane that generally follows the front of the tibia of the intended user to a second plane that generally follows the top and/or side of the user's foot. The flex-control system may further include a second tuning element like the first tuning element for the other of the lateral or medial side of the ankle joint region.

In certain embodiments, the inventive subject matter is directed to a boot with a tongue or tongue region having a first receiver disposed on a lateral or medial side of the tongue or tongue region, and the first receiver configured to receive a tuning element, according to the tuning elements described above, over the lateral or medial side of the ankle joint region and to sufficiently secure the tuning element in place so that the tuning element increases the boot's resistance to flex in the ankle joint region. In the foregoing and other embodiments contemplated herein, the boot may further include a second receiver like the first receiver disposed on the other side of the lateral or medial side of the tongue or tongue region.

In still other embodiments, the inventive subject matter is directed to boot with a tongue or tongue region having a first receiver disposed on a lateral or medial side of the tongue or tongue region, and the first receiver being configured to generally receive a tuning element over the lateral or medial side of the ankle joint region and to sufficiently secure the tuning element in place so that the tuning element increases the boot's resistance to flex in the ankle joint region. In the foregoing and other embodiments contemplated herein, the boot may further include a second receiver like the first receiver disposed on the other of the lateral or medial side of the tongue or tongue region.

The boot in any of the foregoing embodiments or other may be a snowboarding boot, a skate boot, a ski boot, a hiking boot, a running shoe, or other kinds of boots or items of footwear. The tuning element of any of the foregoing embodiments or other embodiments contemplated herein may be a molded plastic element that is semi-flexible and resilient, i.e., capable of withstanding repeated cycles of flexing during the normal life and use of the intended boot.

In certain embodiments, the tuning element has a variable width and/or variable thickness to provide desired characteristics, such as flex control or other performance characteristics. For example, the width of the tuning element may narrow in the ankle hinge region relative to the lower leg region to facilitate flexing in that region.

The boot of any of the foregoing embodiments or other embodiments contemplated herein may have a receiver for the tuning element that is in the nature of a first channel disposed on the boot. In certain embodiments, the channel may be disposed on a tongue for the boot. In such embodiment, the channel may be disposed between inner and outer surfaces of the tongue. In certain embodiments, the channel is a pocket having an opening at the top of the tongue for slideably receiving a tuning element.

In further embodiments, the inventive subject matter is directed to a kit of tuning elements that includes at least two tuning elements of different flex, performance, or cosmetic characteristics. In some embodiments, the kit may include at least two pairs of tuning elements, each pair having a different set of flex-control characteristics. In some such embodiments, one tuning element in a pair is configured to generally conform to lateral side anatomical features of a lower leg or foot and the other to medial side anatomical features of the lower leg or foot.

The tuning element according to any of the foregoing embodiments may be removable from a receiver for the tuning element.

The tuning element according to any of the foregoing embodiments may include a pull-tab or other graspable element for a user to adjust the position of the tuning element in a receiver or remove it from a receiver.

These and other embodiments are described in more detail below and in the accompanying Figures.

The foregoing is not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The accompanying FIGS. 1-13 show a left boot. A right boot is a mirror image.

FIG. 1 is a front, left side perspective of a boot in which one or more tuning elements according to the inventive subject matter may be incorporated.

FIG. 2 shows a perspective view of the inside top portion of the boot of FIG. 1 with tuning elements partially inserted into receivers in the tongue.

FIG. 3 shows the boot of FIG. 2 with the tuning elements fully inserted in the tongue receivers.

FIG. 4 shows the boot of FIG. 2 with a left tuning element almost fully removed from its receiver.

FIG. 5 shows the boot of FIG. 2 with both tuning elements extending partially from their receivers.

FIG. 6 shows a top front perspective view of the boot of FIG. 2 with the tuning elements in the receivers.

FIG. 7 shows a left perspective view of the boot of FIG. 2 with the left tuning element in its receiver.

FIG. 8 shows a top, left perspective view of the boot of FIG. 2 with the left tuning element in its receiver.

FIG. 9 shows a top right perspective view of FIG. 2 with the tuning elements in the receivers.

FIG. 10 shows a side perspective view from a medial position in front of the right tuning element of the boot (left boot) of FIG. 2.

FIG. 11 shows a side view from behind the tuning element of FIG. 10 relative to an orientation of the element when the element is installed in a left boot.

FIG. 12 shows a side perspective view from a lateral position in front of the left tuning element of the boot of FIG. 2.

FIG. 13 shows a side view from behind the tuning element of FIG. 12 relative to an orientation of the element when the element is installed in a left boot.

DETAILED DESCRIPTION

Figure 1:
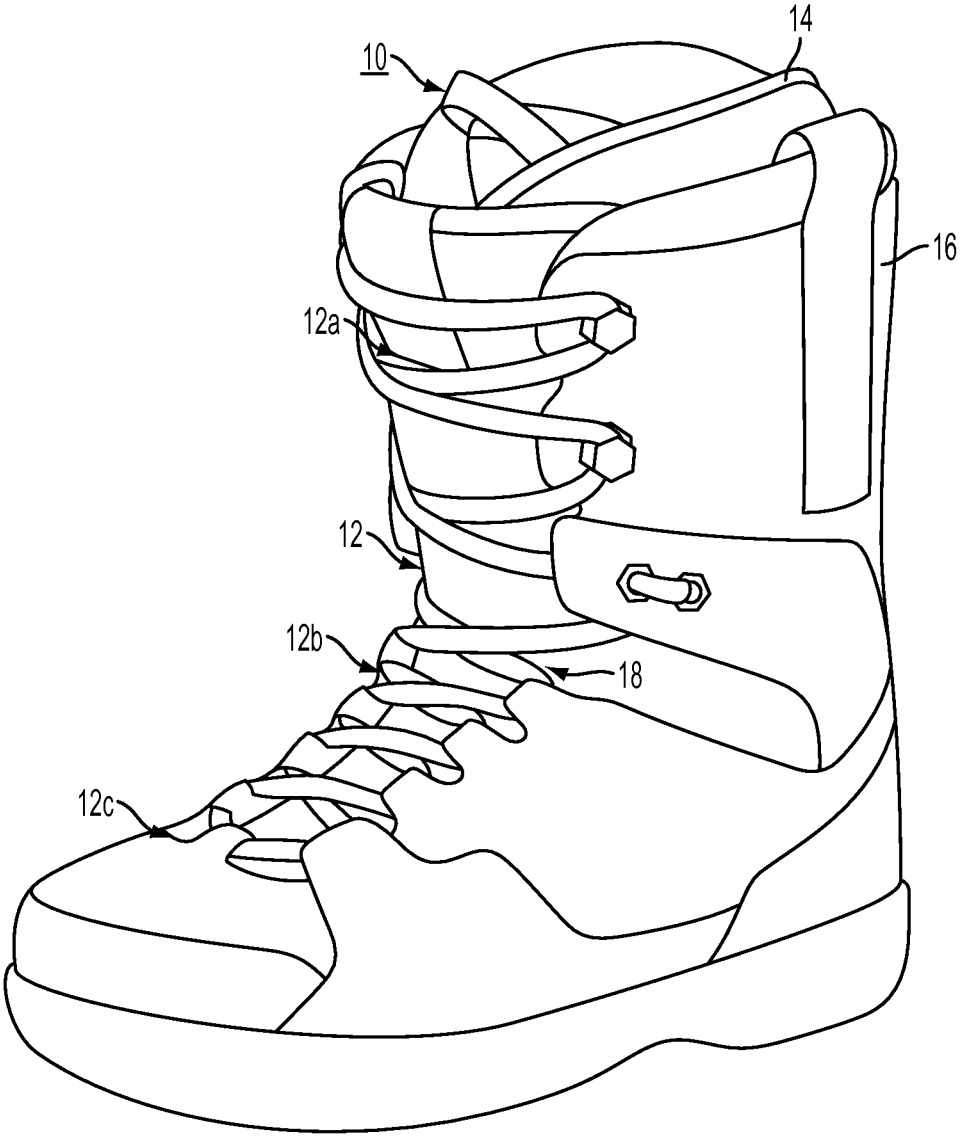
FIGS. 1-13 show embodiments according to the inventive subject matter.

Representative embodiments according to the inventive subject matter are shown in FIGS. 1-13, wherein the same or generally similar features share common reference numerals.

In broad terms, according to the inventive subject matter, one or more tuning elements may be associated with a receiver, such as a pocket or other channel, disposed on an item of footwear, such as a snowboarding boot. The receiver adjustably receives the tuning element. The adjustable arrangement of the tuning element and receiver allows the intended user of the item of footwear to tune the item for performance, comfort, cosmetic or other characteristics.

In certain embodiments, the inventive subject matter described herein generally relates to a tuning system for controlling the flex of a boot. The inventive subject matter is particularly useful with snowboarding boots. It can also be used with a variety of other kinds of boots, including ski boots, skate boots, hiking boots, and any other kind of boot where there is a need to tune the forward flexibility of the boots.

For illustrative purposes, a snowboard boot will be used as a representative boot in which the inventive subject matter may be embodied. From the following discussion, persons skilled in the art will understand how the inventive subject matter may be embodied in other forms of boots. A snowboard boot 10 typically has a tongue 12 or a region corresponding to a tongue, in the case of a tongueless boot, such as rear entry boot (hereinafter tongue and corresponding region at a tongueless boot may be simply referred to as the "tongue"). The boot has an inner liner 14, which is usually removable. The boot has an outer shell 16 into which the inner liner is disposed. The inner liner as well as the shell may have a tongue or a tongue region. Lateral edges of the upper of the boot are spaced apart and in-filled by tongue 12. The lateral edges include a closure system such as the lacing system shown. Other closure systems could be based on straps, buckles, reel/cables, and other known or to be discovered closure systems.

The tuning elements disclosed herein may be associated with the tongue 12 or tongue region for liner 14 and/or the tongue or tongue region for outer shell 16. In the exemplary embodiments disclosed in the Figures, the boot 10 has a tuning element **20*a* associated with a lateral side of the boot and a tuning element 20*b* associated with a medial side of the boot. In some embodiments, the tuning elements are slideably disposed so that relative to the ground they move generally vertically over the upper tongue region 12*a* of the boot, angularly relative to instep area 12*b*, and generally horizontally relative to lower tongue or foot region 12*c***. The tuning element may be semi-flexible, resilient planar structures to accommodate sliding in the different planes of the foregoing regions. Or it may be a three-dimensionally contoured structure that generally conforms to the contours of the different regions, as described in the examples discussed below.

Boot 10 has a flex zone 18 that generally corresponds to the ankle joint of the intended wearer. The ankle joint is the hinge joint between the foot and the leg. The uppermost bone of the foot, called the talus (ankle-bone), is disposed between the two bony protuberances formed by the lower ends of the tibia (shin bone) and the fibula. By locating a portion of the tuning elements over the ankle hinge joint, the tuning element can influence the level of force and pattern of force (e.g., constant force or progressive force) for flexation at the joint. A tuning element that remains completely rigid under normal loads of use for the boot would not allow any flexation, while a thin, highly flexible tuning element would have negligible impact on flexation. By varying the flexibility of the tuning element structure, a range of flexation control can be provided.

Accordingly, the boot can be constructed so that one or more tuning elements may be selectively located over the hinge joint on the lateral and/or medial sides to control the flex of the boot at the flex zone 18. A first configuration for a boot that provides maximum flexibility and minimum stiffness would have no tuning element disposed on the lateral or medial sides of the tongue or tongue region. A second configuration of a boot with medium flexibility or medium stiffness could have a tuning element disposed over just a lateral or medial side of the tongue or tongue region. A third configuration for minimum flexibility or maximum stiffness could have tuning elements disposed on both the lateral and medial sides of the tongue or tongue region. To allow for such control, some or all of the tuning element may be selectively adjusted so that it may be dislocated from the hinge joint, and therefore no longer influencing the amount of force needed for flexation.

In the embodiment shown in the Figures, tuning elements 20*a*, 20*b* are slideably disposed in pockets 24*a* and 24*b*. The pockets are disposed in between the inner and outer surfaces of outer shell 16. The pockets are channels that extend from the top of tongue 12 to the front portion of the lower tongue region 12*c*. The size and shape of the channels generally correspond to the size and shape of the tuning elements, which are elongated in shape. When the tuning elements are pushed down into the pockets, they are are guided by the channels along regions 12*a*, 12*b*, and 12*c*. With both tuning elements fully slid into the channels and across flex zone 18, the boot is in its stiffest flex configuration.

Figure 2:
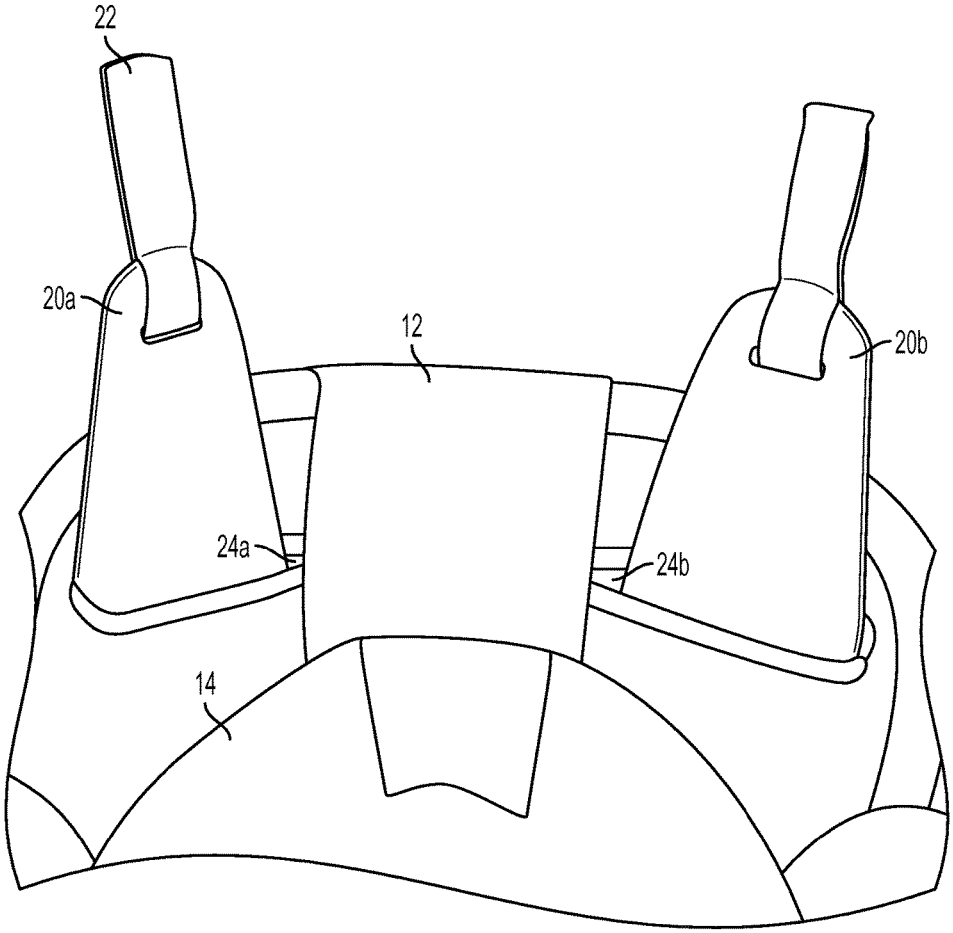
Figure 3:
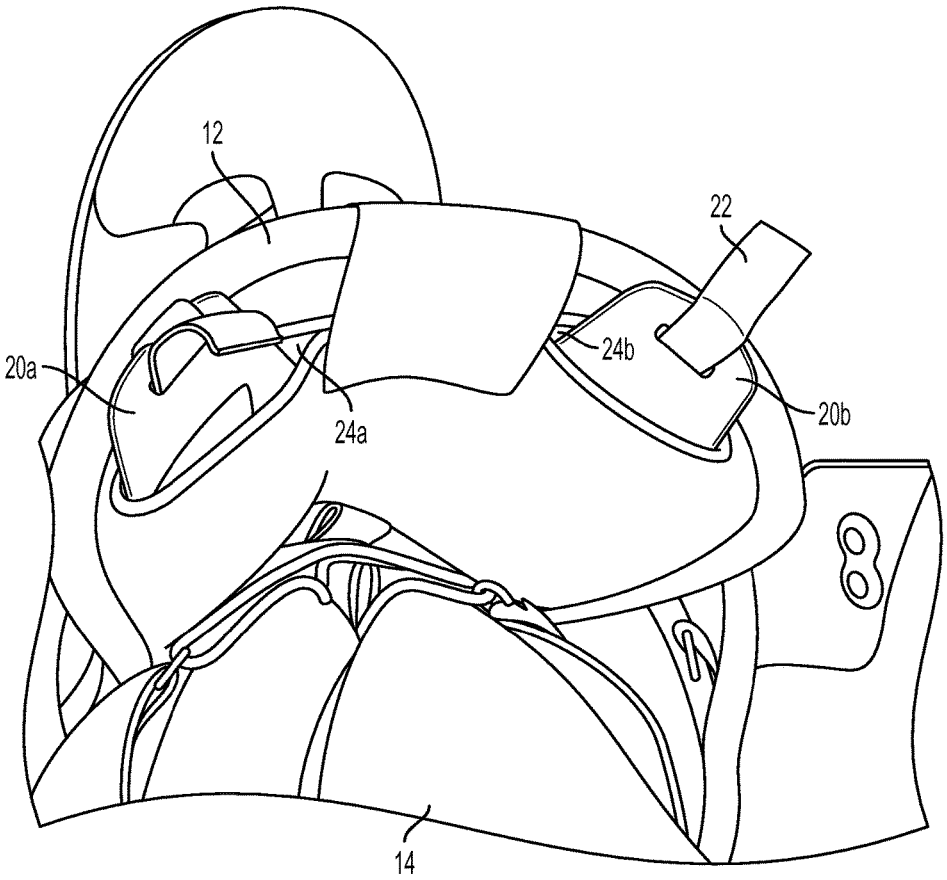
Figure 4:
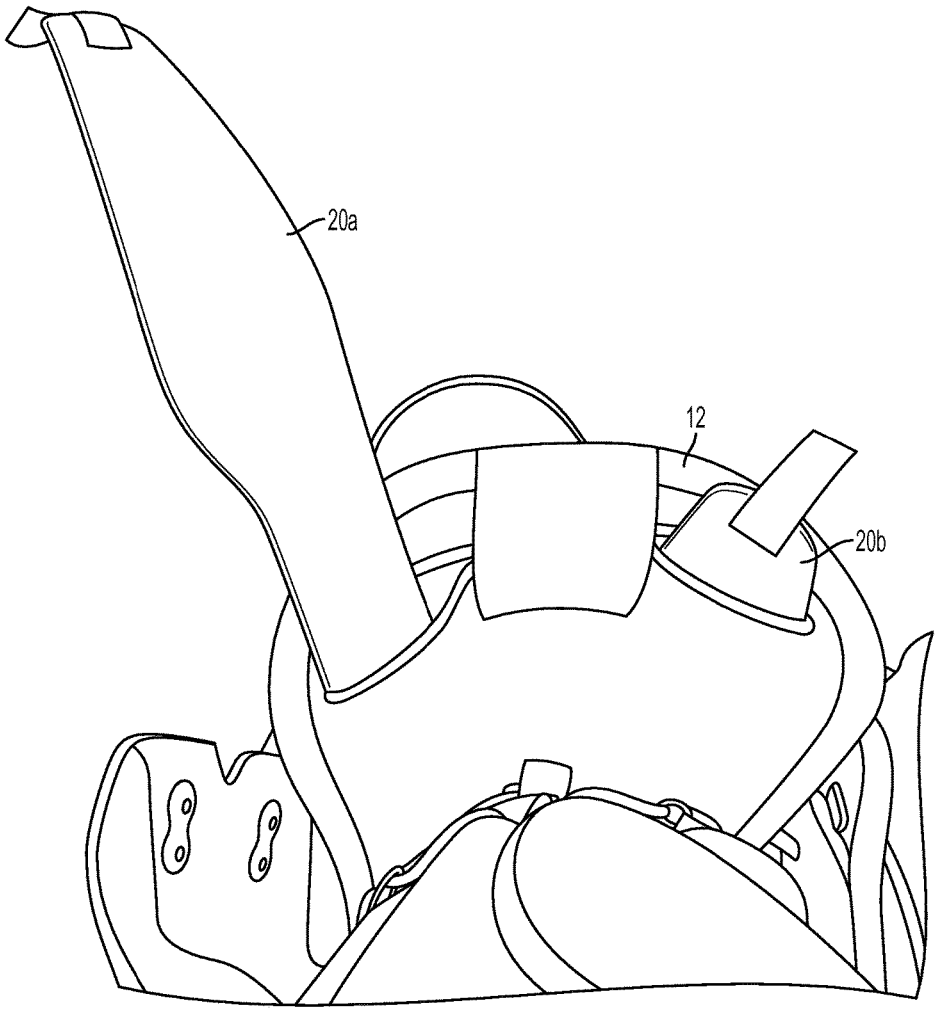

FIGS. 2-3 show a pair of tuning elements 20*a*, 20*b* fully or almost fully inserted into receivers, such as pockets 24*a*, 24*b*, as viewed from the inside surface of outer shell 16. In the embodiments shown, the tuning elements in a pair may have mirror configurations. The tuning elements may optionally include a pull tab 22 or other graspable element for sliding up a tuning element out of a pocket or other channel. FIG. 4 shows a lateral tuning element 20*a* partially removed from pocket 24*a*. Its lower end would be above flex zone 18 and therefore no longer influencing the flexibility of the ankle hinge. Medial tuning element 20*b* is still in place and therefore capable of restricting the flexibility of the boot. It will particularly restrict flexibility on the medial side, thereby creating an asymmetrically tuned response to forces applied toward the medial direction. With just one tuning element dislocated from the flex zone 18, the boot is now in its medium flex configuration.

Figure 5:
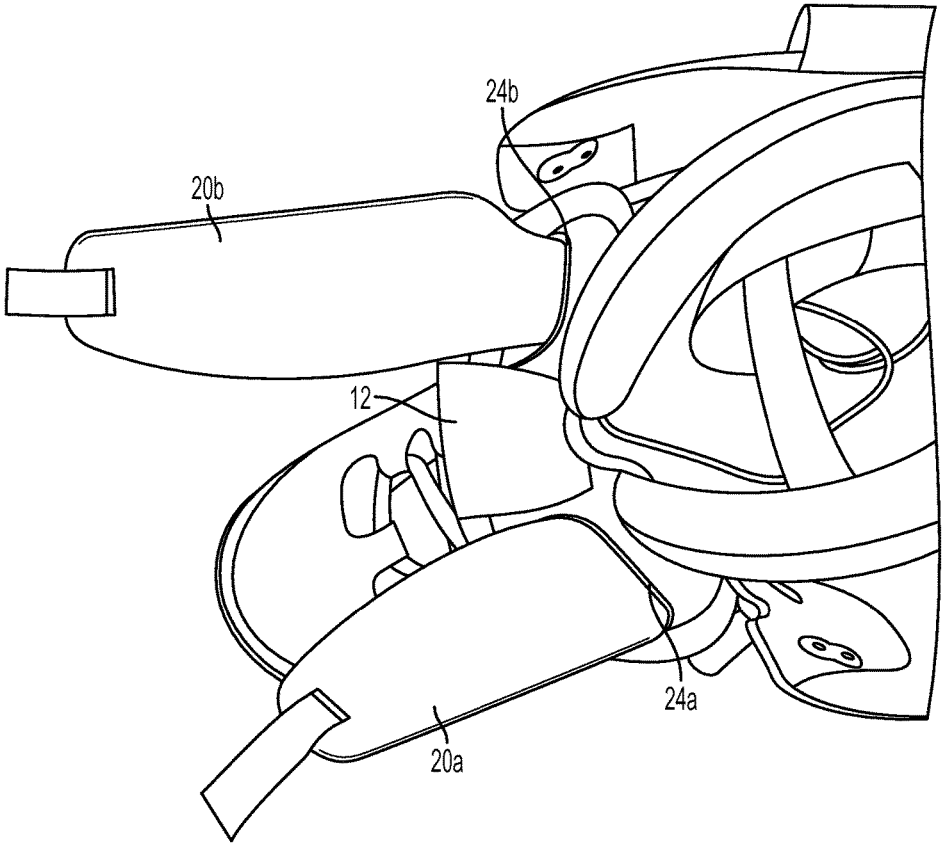
Figure 6:
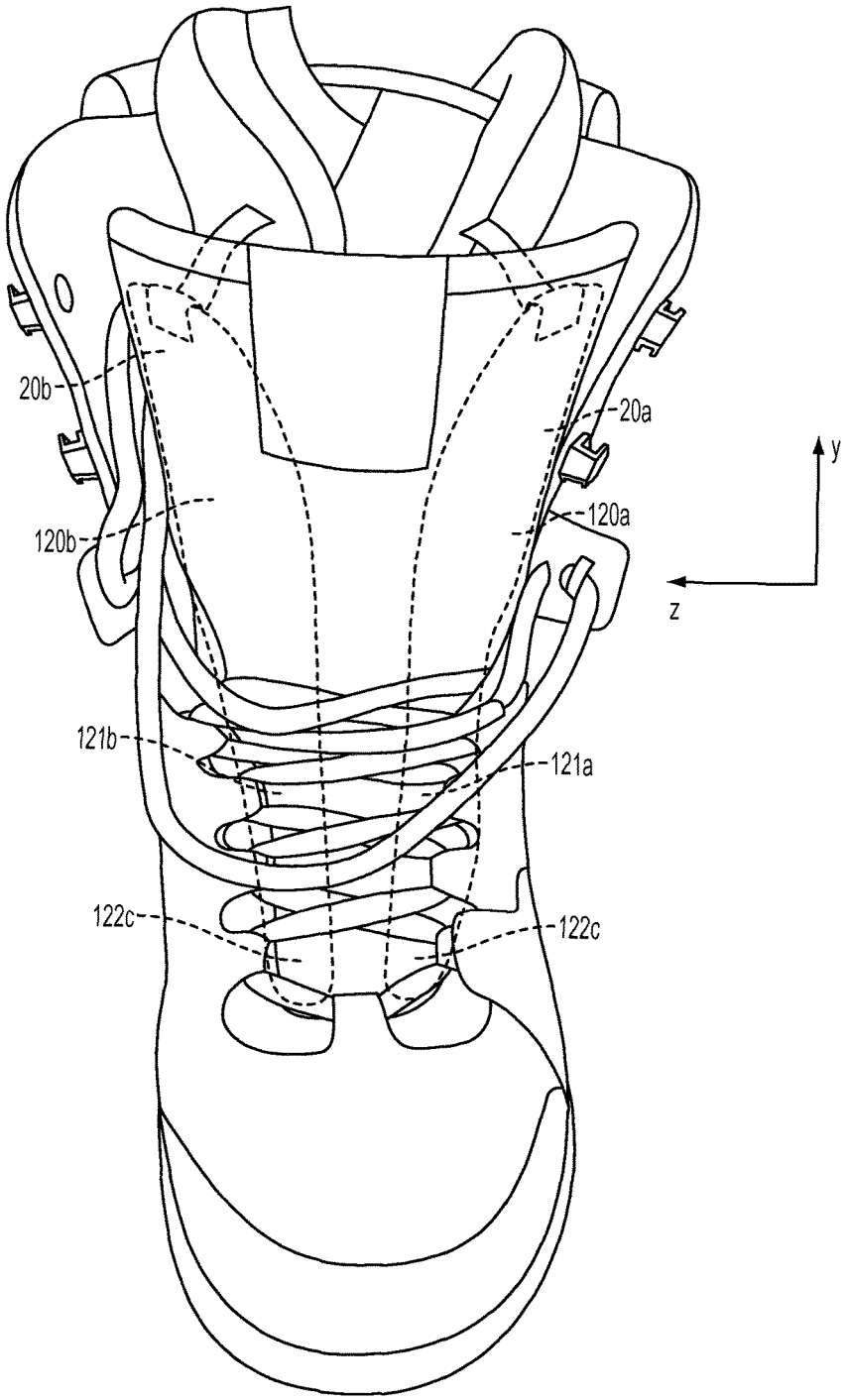
Figure 7:
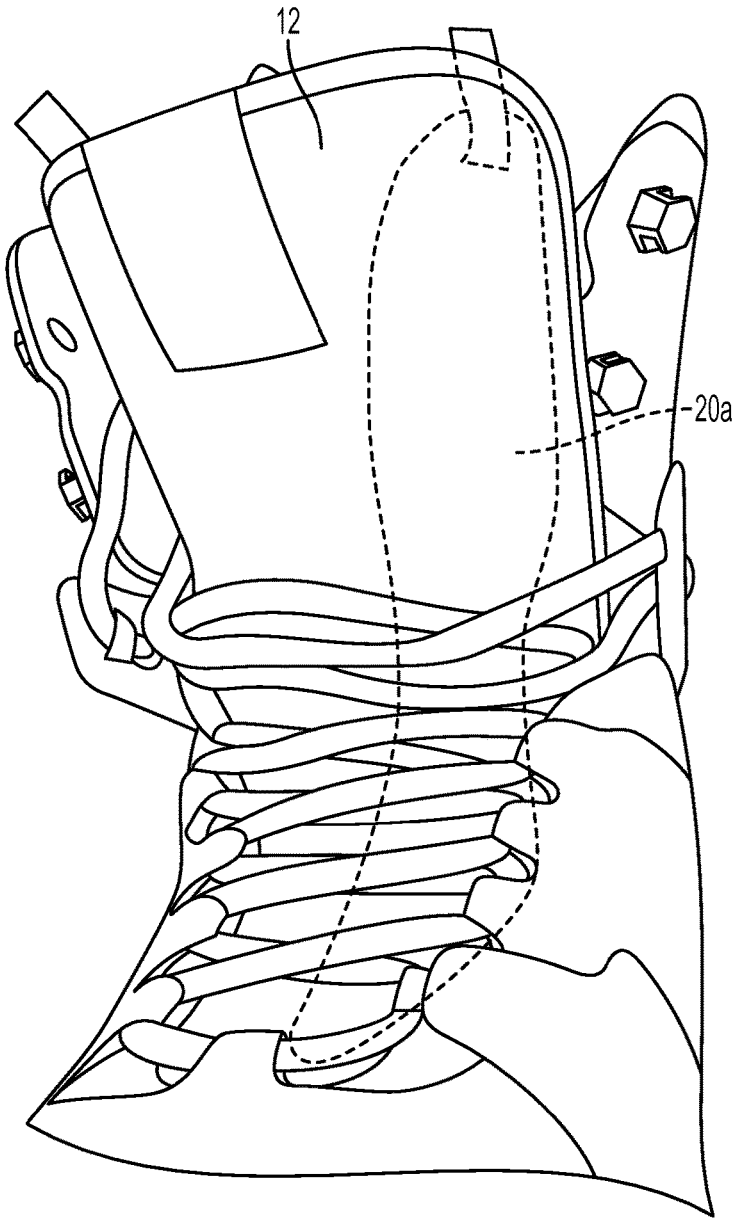
Figure 8:
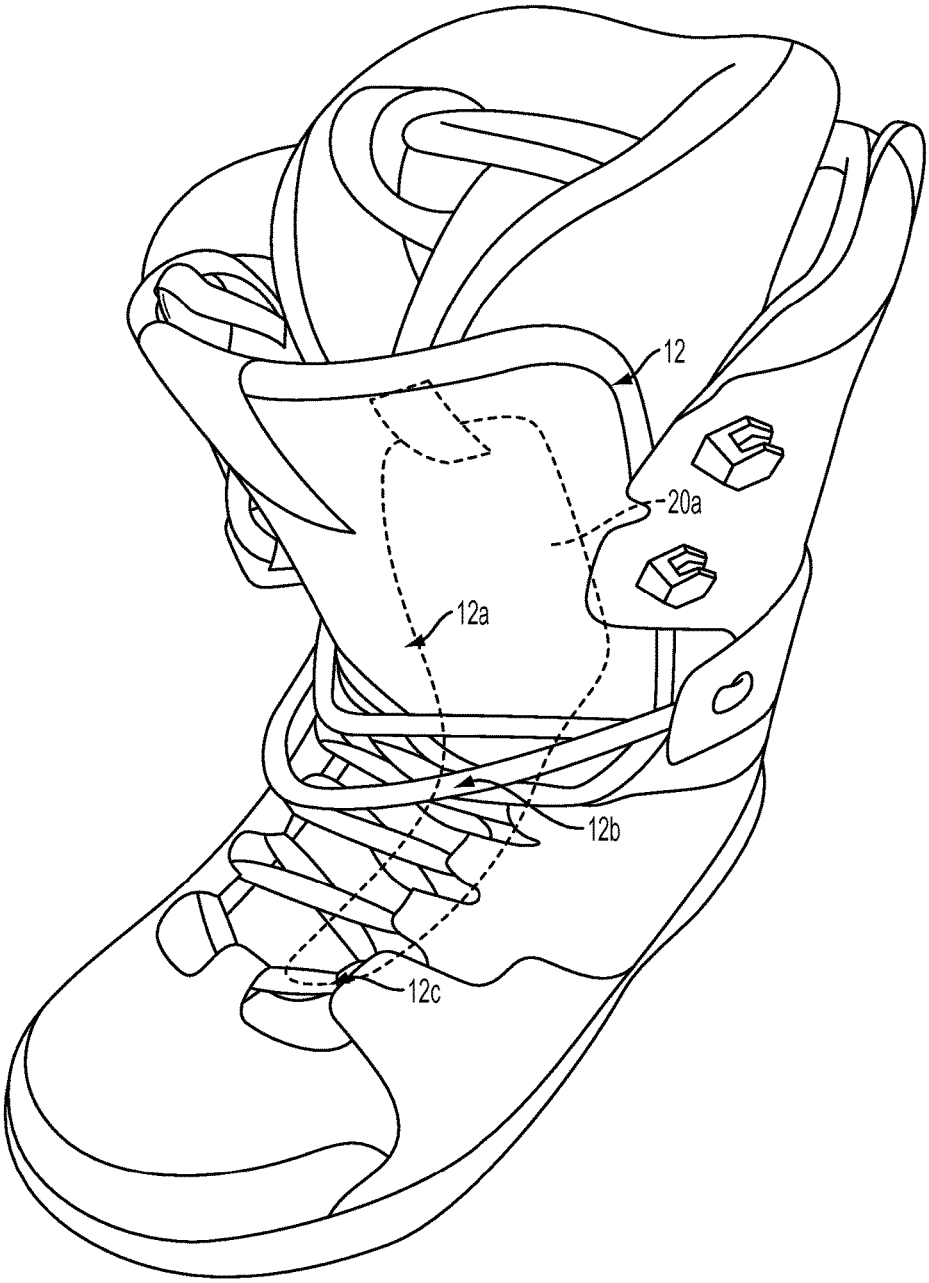
Figure 9:
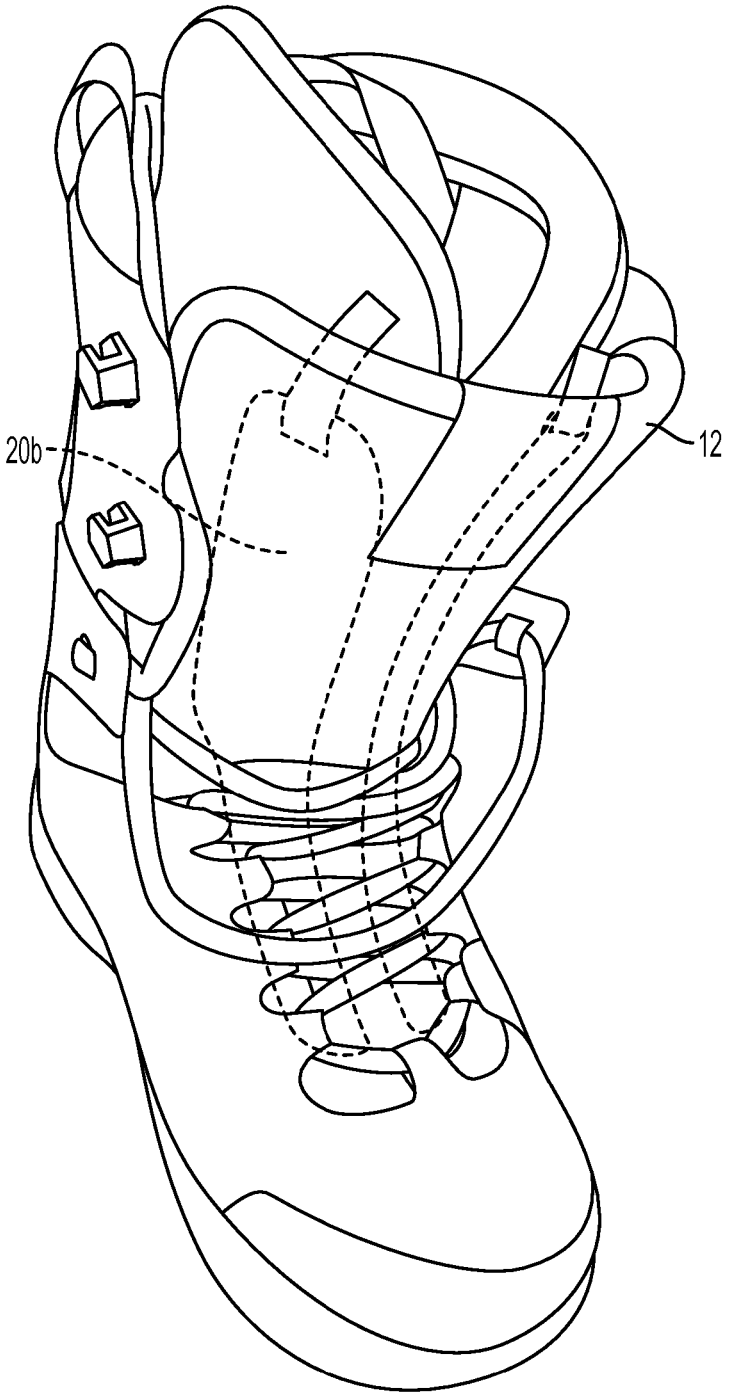

FIG. 5 shows both the medial tuning elements partially removed in the same manner as described above for the lateral element. With both elements dislocated from the flex zone 18, the boot now is in its most flexible configuration.

FIGS. 6-9 show the tuning elements in their receivers in the boot to illustrate the general location and size, shape and path of the receivers, e.g., pockets, disposed in tongue 12.

As described above and shown in the Figures, each tuning element may extend from an upper portion of the boot corresponding to a lower leg region, across the front of the ankle, and over at least a portion of the instep of a user's foot.

The tuning elements may be associated with the boot on the inside surface, an outside surface, or as embedded elements in between inner and outer surfaces.

As indicated above, the tuning elements can work individually or together depending on the desired performance of the boot. In certain embodiments of the inventive system, the tuning elements may be inserts that slide inside of the boot's outer shell tongue, using a pocket to secure them from moving around. Placing the inserts on the inside of the outer shell does not affect the exterior design aesthetics and reduces the chance of pressure points.

The tuning elements may be configured and located so as to influence the medial, lateral, back and/or front fit and performance of an item of footwear, allowing customization to each user. In the examples illustrated in the Figures, each tuning element is placed along the medial side and the lateral side of the outer shell tongue, and accessible at the top of the tongue. Thereby, the tuning elements are easily accessible to the user when the boot is in use, allowing for on-the-fly adjustments. The tuning elements optionally have a nylon webbing pull-tab 22 that is connected at the top through a pre-molded hole or any other means for fastening, coupling or integrating. This allows the tuning elements to be reached and removed out of the pocket easily. The inserts may have a structural texture, e.g., a patterned, raised grid, applied to the front and backsides, creating support throughout the part and frictional engagement for added security from movement inside the pocket.

Figure 10:
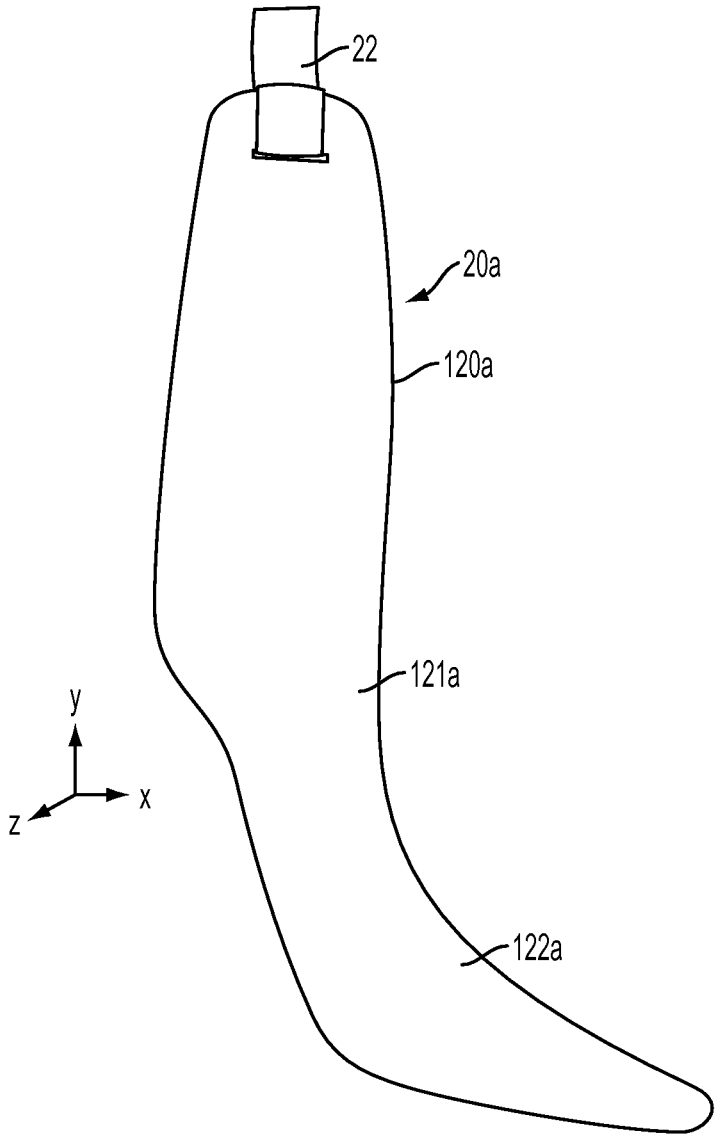
Figure 11:
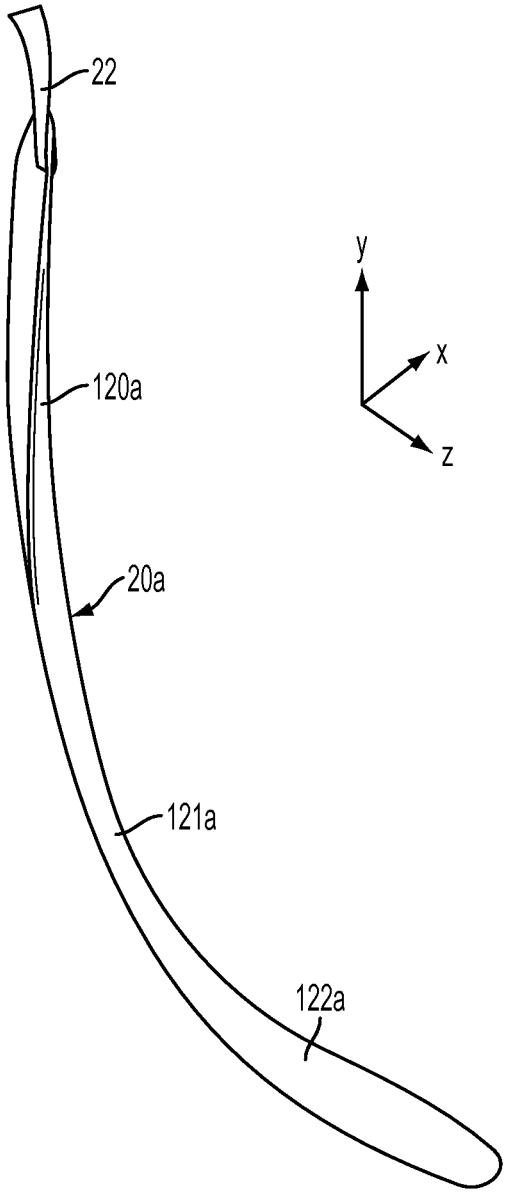
Figure 12:
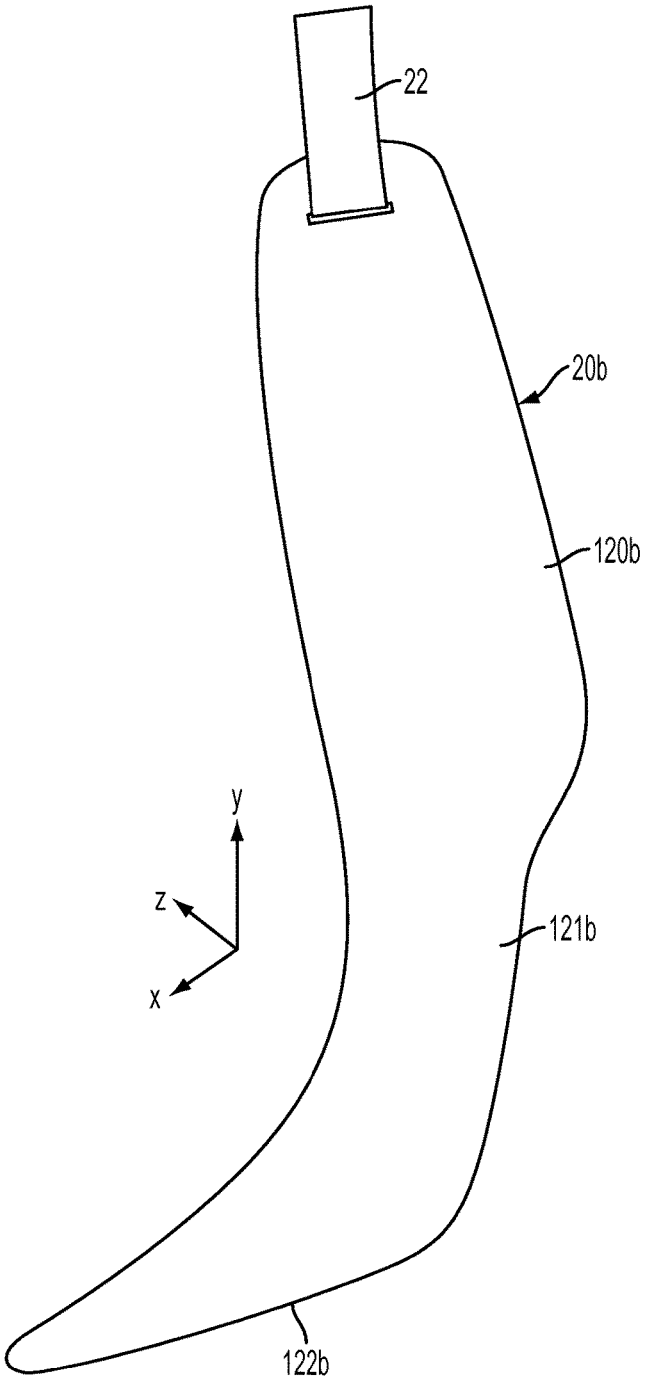
Figure 13:
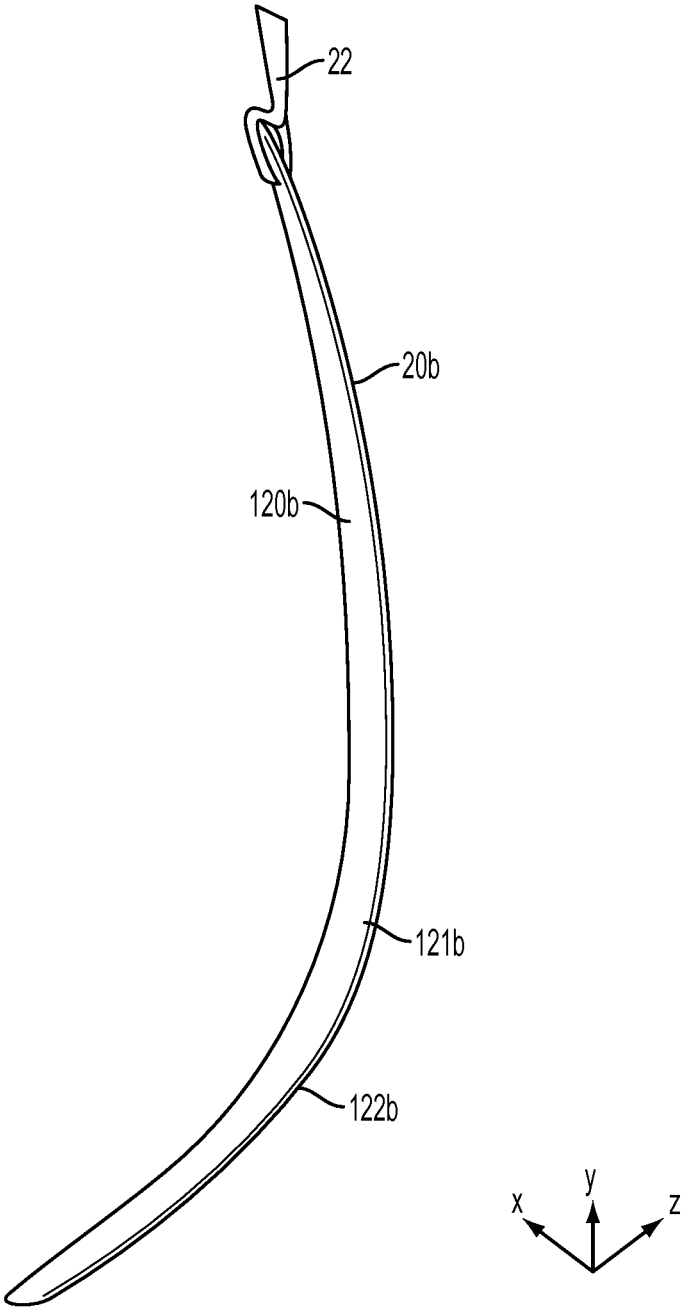

FIGS. 10-13 show lateral (left side) and medial (right side) tuning elements 20*a*, 20*b* standing apart from a boot. FIGS. 10-11 are front and side views of the right tuning element for the left boot shown. And FIGS. 12-13 are corresponding views for the left tuning element. The tuning elements shown are mirror images in this case, but they can have independent conformations. The system is customizable according to the nature of the product, the affected area, and the performance needed. The tuning elements may be designed specifically for the medial (inside) and lateral (outside) anatomy and ergonomics of the foot by adjusting the shape, support, materials, structural configuration, and/or placement on the boot or other item of footwear.

In the examples shown in the Figures, the tuning elements have conformations designed to distribute pressure away from the foot, and the tuning elements may taper at the edges creating a progressive flex and feel. The tuning elements shown are intended to transfer pressure away from the top of the foot through the anatomical shape and/or by the varying thickness moving to the edge.

The wider area of the tuning element 120*a*, 120*b*, corresponding to the upper tongue region 12*a*, helps distribute force to avoid pressure points and to provide more responsive feel to the boot. That area may be configured to conform to contours of the tibia area of a lower leg. The relatively narrow area 121*a*, 121*b* in the tuning elements, corresponding to flex zone 18, allows for more flexibility. The flex zone (also generally indicated by reference numbers 121*a*, 121*b*) is a transition zone where the tuning element may angle or curve from a first generally plane, oriented along an y-axis that follows the front of the tibia, to a second or third general plane, oriented along z and/or x axes, along the top and/or side of the foot. The areas 122*a*, 122*b* of the tuning elements extend from the flex zone 18, across the top of the foot, and generally correspond to region 12*c*. These areas help distribute pressure to avoid pressure points and improve responsiveness of the boot. The elbow in the tuning element at areas 121*a*, 121*b*, just below the flex zone 18 distributes pressure more to the side of the foot, which is less sensitive than the top of the foot. Thicker portions in a given material will increase rigidity. Flexibility may also be influenced by structural configurations. For example, corrugations in a tuning element may increase strength or stiffness. Grooves or other hinging structures may be formed in materials to increase flexibility, for example. The anatomical features may create a constant flex with gradual support and customized performance to the user. In other embodiments, the tuning elements can be configured to provide progressive changes in flexibility, e.g., progressively stiffer flex. This may be achieved by varying material thickness or use of different materials or structures in different portions of a tuning element. Advantageously, a kit of tuning elements can give the user a variety of flexibility options, a variety of differential flex responses on lateral and medial sides of the boot, and a variety of constant or progressive flex options. The inventive subject matter also contemplates that tuning elements can be stacked to provide fine-tuning in a given receiver.

A set of tuning elements may be associated with different categories of products, e.g., snowboarding boots and skate boots. Having multiple inserts for a given receiver in the same or different products allows the user to create a customized performance and/or experience for such product or products during its use.

Tuning elements according to the inventive subject matter are not limited to use in controlling flex; they may impart other characteristics in addition to or instead of flex characteristics. For example, the tuning element may be a heating element that is thermoelectric or thermochemical in nature. A tuning element could be a cosmetic element that imparts 2D or 3D design features, such as varying colors, graphical images, sculptural features, or branding or other indicia of source or affiliation. A tuning element could include one or more electronic sensors such as GPS sensors, accelerometers, electronic compass devices, piezoelectric devices (e.g., pressure or force sensors), RFID devices, microprocessors, memory devices, etc. A tuning element could also be a comfort device that provides additional cushioning against a user's foot or leg.

The tuning elements can be designed to any size, shape, or material depending on what the desired end purpose is. Among suitable materials are resilient plastics such as TPU, TPE, other thermoplastics, composites, such as carbon fiber and fiber glass, and spring metals.

In addition to the tongue, the tuning elements can potentially be placed anywhere in an item of footwear that would allow the user to adjust the function, flex, fit, feel, support, and overall performance. Among the areas that tuning elements could affect include, but are not limited to, the tongue, liner, eye-row, heel (back support), foot-bed, sole unit, medial side, lateral side, etc.

In some embodiments, a tongue or other region may have more than two tuning elements to allow for a greater range of tuning options. For example, there could be one or more other tuning elements that disposed more centrally, in between the lateral and medial tuning elements.

Removable tuning elements allow riders to custom tune their boot flex. Keep them both in for maximum support, use just one to provide either increased lateral or medial response, or remove them entirely for a softer flexing boot.

The receivers for the tuning elements can be pockets, grooves, and other channels, straps, gillies, molded guides, snap fasteners, hook and loop fasteners, for example, VELCRO, etc. Another option could be having internal pockets that are accessible from the outer surface of outer shell 16. For example, by die cutting holes in the outer surface, it would allow for the inserts to be removed from the internal pockets externally. The inserts could also stick up and out from the outer shell allowing for easy access and removal.

As indicated above, the inventive system could be used as a modular system working with a plurality of tuning elements affecting the performance of one or more different products in the same or different ways. For example, a modular system could take the tuning elements out of a snowboard boot and using them in a skate boot, hiking boot, or running shoe. A tuning element configured for use in a boot or shoe could also be configured for use as a standalone item, such as an orthopedic item, e.g., a knee brace.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

Any patent and non-patent literature cited herein is hereby incorporated by references in its entirety for all purposes.

As used herein, "and/or" means "and" or "or", as well as "and" and "or." Moreover, any and all patent and non-patent literature cited herein is hereby incorporated by references in its entirety for all purposes.

The principles described above in connection with any particular example can be combined with the principles described in connection with any one or more of the other examples. Accordingly, this detailed description shall not be construed in a limiting sense, and following a review of this disclosure, those of ordinary skill in the art will appreciate the wide variety of permutations of features and elements that can be devised using the various concepts described herein. Moreover, those of ordinary skill in the art will appreciate that the exemplary embodiments disclosed herein can be adapted to various configurations without departing from the disclosed principles.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more".

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under US patent law, unless the element is expressly recited using the phrase "means for" or "step for".

The inventors reserve all rights to the subject matter disclosed herein, including the right to claim all that comes within the scope and spirit of the following claims:

The invention claimed is:

1. A boot with a tongue having a first receiver disposed on a lateral or medial side of the tongue and a corresponding tuning element, and the first receiver being configured to removably and slideably receive the tuning element generally over the lateral or medial side of an ankle joint region and to sufficiently secure the tuning element in place so that the tuning element is disposed from an upper portion of the boot corresponding to a lower leg region, across the front of the ankle joint region, and over at least a portion of an instep region of the boot, wherein the tuning element is disposed on a lateral or medial side of the tongue, and thereby increases the boot's resistance to flex in the ankle joint region, and at least a mid-portion of the first receiver is configured so as to restrict the tuning element off a longitudinally central portion of the instep, leaving the longitudinally central portion of the instep exposed so as to distribute pressure more to the lateral or medial side of the boot.

2. The boot of claim 1 further comprising a second receiver configured mirroringly like the first receiver disposed on the other of the lateral or medial side of the tongue.

3. The boot of claim 2 further comprising a second tuning element, each tuning element configured to correspond to a respective receiver.

4. The boot of claim 3 wherein the tuning elements each comprise a molded plastic element.

5. The boot of claim 4 wherein at least one tuning element has a variable thickness and/or width.

6. The boot of claim 5 wherein the at least one tuning element has a variable width.

7. The boot of claim 6 wherein the at least one tuning element has a variable width and variable thickness.

8. The boot of claim 5 wherein the width of the at least one tuning element narrows in the ankle joint region relative to the lower leg region.

9. The boot of claim 1 wherein the boot comprises a snowboarding boot.

10. The boot of claim 1 wherein the first receiver comprises a first channel disposed on the boot.

11. The boot of claim 10 wherein the channel is disposed on the tongue for the boot.

12. The boot of claim 11 wherein the channel is disposed on the boot between inner and outer surfaces of the tongue.

13. The boot of claim 12 wherein the channel is a pocket having an opening at the top of the tongue for slideably receiving a tuning element.

14. The boot of claim 1 wherein the tuning element includes a transition zone where the tuning element angles or curves from a first plane that is configured to generally follow the front of the intended user's tibia to a second plane that is configured to generally follow the top and/or side of the intended user's foot.

* * * * *